US010323395B1

(12) United States Patent
Troiani

(10) Patent No.: US 10,323,395 B1
(45) Date of Patent: Jun. 18, 2019

(54) TUB AND SHOWER VALVE REPLACEMENT SYSTEM

(71) Applicant: Matthew F. Troiani, Mt. Pleasant, SC (US)

(72) Inventor: Matthew F. Troiani, Mt. Pleasant, SC (US)

( * ) Notice: Subject to any disclaimer, the term of this patent is extended or adjusted under 35 U.S.C. 154(b) by 0 days.

(21) Appl. No.: 15/884,286

(22) Filed: Jan. 30, 2018

(51) Int. Cl.
*F16K 43/00* (2006.01)
*E03C 1/04* (2006.01)
*E03C 1/02* (2006.01)

(52) U.S. Cl.
CPC ..... *E03C 1/0401* (2013.01); *E03C 1/021* (2013.01)

(58) Field of Classification Search
CPC ..... E03C 1/0401; E03C 1/0402; E03C 1/042; E03C 1/0408; E03C 2001/028
See application file for complete search history.

(56) References Cited

U.S. PATENT DOCUMENTS 1,414,792 A * 5/1922 Seither ..... E03C 1/0401 285/20
3,167,855 A * 2/1965 Moen ..... E03C 1/042 137/15.17
3,443,266 A * 5/1969 Ellison ..... E03C 1/042 137/359
3,609,774 A * 10/1971 Allgood ..... E03C 1/021 137/359
4,457,031 A * 7/1984 Moore ..... A47K 4/00 4/570
4,654,900 A * 4/1987 McGhee ..... E03C 1/042 4/661
5,813,431 A * 9/1998 Cool ..... E03C 1/042 137/359
6,178,981 B1 * 1/2001 Wales ..... E03C 1/042 137/15.18
7,210,493 B1 5/2007 Wang
7,886,762 B1 * 2/2011 Carter ..... E03C 1/021 137/359
2004/0237189 A1 12/2004 Ross
2008/0250557 A1 10/2008 Mueller
2013/0269794 A1 10/2013 Field
2014/0325752 A1 11/2014 Tuineag

* cited by examiner

*Primary Examiner* — Reinaldo Sanchez-Medina
(74) *Attorney, Agent, or Firm* — Olav M. Underdal; IDP Patent Services

(57) ABSTRACT

A valve repair system includes: a main plate which is secured to a wall with fastener members, main plate screws, plate standoffs, valve to plate spacers, a replacement valve, and a front cover plate, such that the front cover plate is mounted in front of the main plate, and is tightened in place with the cover plate fasteners, such that the front cover plate is tightened against the main plate with the cover plate fasteners, such that the replacement valve is pulled in towards the main plate, such that the valve to plate spacers are locked tightly between the main plate and the replacement valve.

19 Claims, 5 Drawing Sheets

Valve Repair System

Valve Repair Kit

Pipe Holder

TUB AND SHOWER VALVE REPLACEMENT SYSTEM

CROSS-REFERENCE TO RELATED APPLICATIONS

N/A.

FIELD OF THE INVENTION

The present invention relates generally to the field of plumping fixtures and systems, and more particularly to methods and systems for tub and shower valve replacement.

BACKGROUND OF THE INVENTION

Replacement of older two- and three-handle tub and shower valves can be done using a conventional valve repair kit, which includes a front plate that is usually oval-shaped and football sized. These plates offer little room to do piping and are very difficult to install when a valve is positioned low, near the tub spout of a tub and shower. They look undesirable and are difficult to install in.

As such, considering the foregoing, it may be appreciated that there continues to be a need for novel and improved devices and methods for shower and bath valve replacement.

SUMMARY OF THE INVENTION

The foregoing needs are met, to a great extent, by the present invention, wherein in aspects of this invention, enhancements are provided to the existing model of devices and methods for shower and bath valve replacement.

In an aspect, a valve repair system can include:

a) a main plate;

b) a plurality of fastener members, which are configured to secure the main plate around an opening in a wall;

c) a replacement valve, which is configured to connect to existing wall piping;

d) a front cover plate, which is usually supplied with a replacement valve, in a conventional valve replacement kit; and e) a plurality of cover plate fasteners;

such that the valve to plate spacers are configured to be positioned between the replacement valve and the main plate;

wherein the front cover plate is mounted in front of the main plate, and is tightened in place with the cover plate fasteners, such that the front cover plate is tightened against the main plate with the cover plate fasteners, such that the replacement valve is pulled in towards the main plate.

In a related aspect, the valve repair assembly can further include:

at least two valve to plate spacers;

such that the valve to plate spacers are locked tightly between the main plate and the replacement valve.

In a related aspect, the valve repair assembly can further include:

at least one plate standoff, which is mounted between the main plate and a fastener member in the plurality of fastener members.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
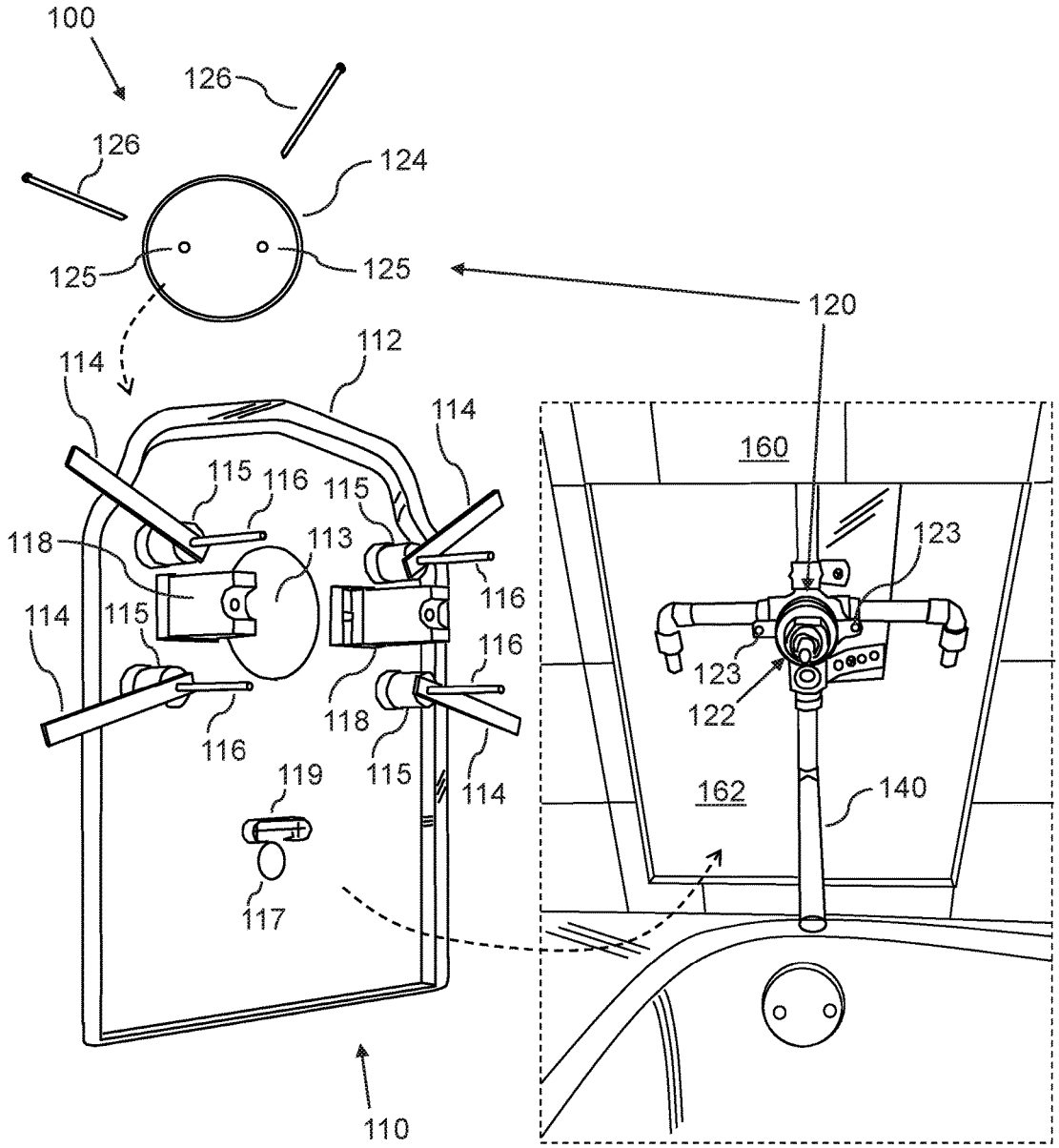
FIG. 1 is a perspective view of parts a valve repair system prior to installation in a bathroom, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a valve repair system 100 with reference to FIG. 1, in such manner that like reference numerals refer to like components throughout; a convention that we shall employ for the remainder of this specification.

Figure 2:
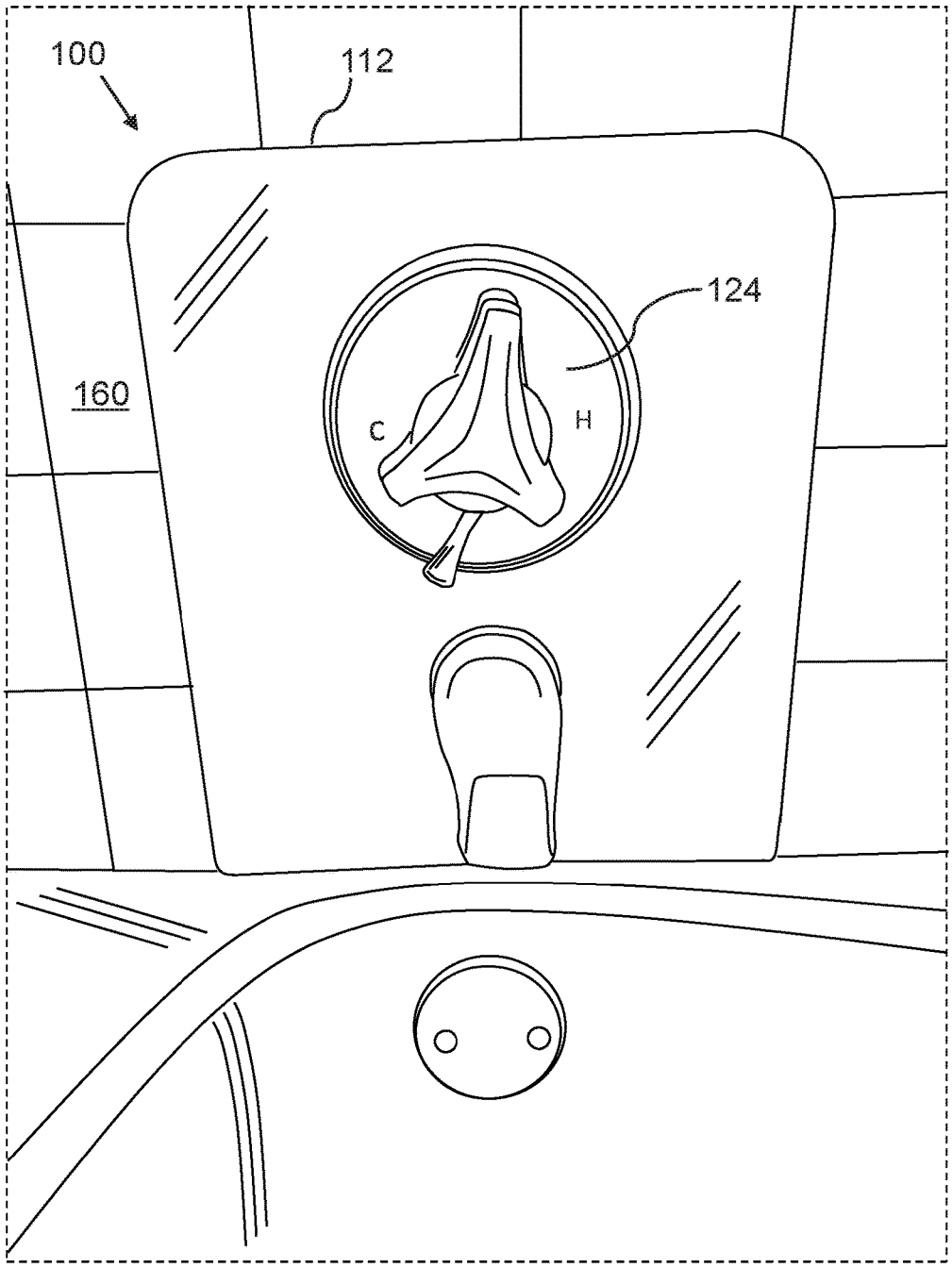
FIG. 2 is a perspective view of a valve repair system installed in a bathroom, according to an embodiment of the invention.
Figure 5A:
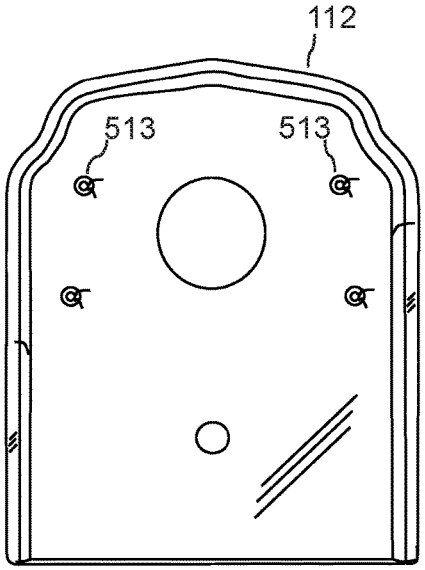
FIG. 5A is a perspective view of a main plate of a valve repair kit, according to an embodiment of the invention.
Figure 5B:
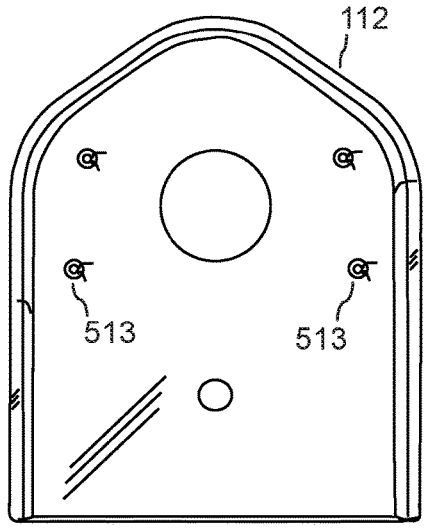
FIG. 5B is a perspective view of a main plate of a valve repair kit, according to an embodiment of the invention.
Figure 6A:
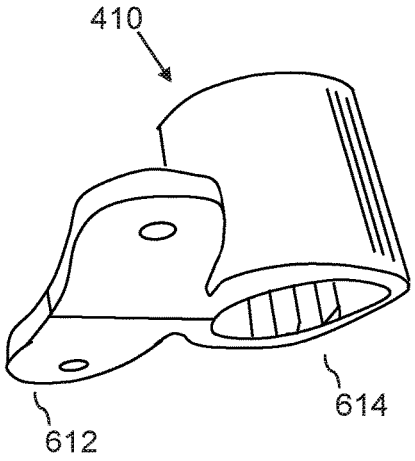
FIG. 6A is a perspective view of a pipe holder of a valve repair kit, according to an embodiment of the invention.
Figure 6B:
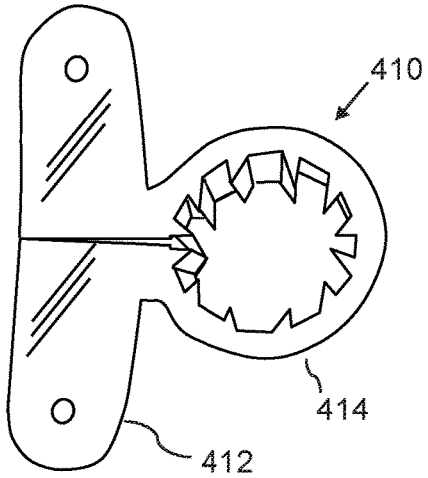
FIG. 6B is a perspective view of a pipe holder of a valve repair kit, according to an embodiment of the invention.

In an embodiment a valve repair system 100, as shown in FIGS. 1 and 2, can include:

a) A valve repair kit/assembly 110, including:
   i. a main plate 112;
   ii. a plurality of fastener members 114, which are configured to secure the main plate 112 around an opening 162 in a wall 160, which fastener members 114 can typically be made of a metal or in some cases from a high-strength composite;
   iii. a plurality of main plate screws 116, which can be made from a metal, such as stainless steel;
   iv. a plurality of plate standoffs 115, which are mounted between the main plate 112 and the fastener members 114, such that each main plate screw 116 protrudes through a main plate aperture 513 (as shown in FIGS. 5A and 5B) and a central aperture 335 (shown in FIG. 3) of a plate standoff 115, and screws into a fastener member 114; and
   v. at least two valve to plate spacers 118; and b) a replacement valve kit/assembly 120, including:
   i. a replacement valve 122, which is configured to connect to existing wall piping;
   ii. a front cover plate 124, which for example can be round or oval/football shaped. The front cover plate is usually supplied as a part of a conventional replacement valve kit 120; and
   iii. a plurality of cover plate fasteners, which can be cover plate screws 126 or cover plate push-lock fasteners 126, or some other type of cover plate locking fastener 126;

wherein the main plate 112 is secured to the wall with the fastener members 114;

such that the valve to plate spacers 118 are positioned between the replacement valve 122 and the main plate 112;

wherein the front cover plate 124 is mounted in front of the main plate, and is tightened in place, with cover plate screws 126 screwed through cover plate apertures 125, via a main valve aperture 113 of the main plate 112, such that the cover plate screws 126 are screwed into apertures 123 of the replacement valve 122, such that the front cover plate 124 is tightened against the main plate 112, such that the replacement valve 122 is pulled in towards the main plate 112, such that the valve to plate spacers 118 are locked/sandwiched tightly between the main plate 112 and the replacement valve 122;

such that if the replacement valve 122 is installed as a floating installation, the replacement valve 122 is tightly secured to the main plate 112 that is tightly secured to the wall 160, such that the floating installation of the replacement valve 122 is converted to a stabilized installation;

wherein the main plate 112, the valve to plate spacers 118 and the plate standoffs 115 can be made from a plastic material, such as ABS.

In a related embodiment, FIG. 2 shows a perspective view of the valve repair system 100 installed in a bathroom. The valve repair system 100, can also be referred to as the goof plate update 100, the goof plate system 100, or the goof plate repair system 100.

Figure 3:
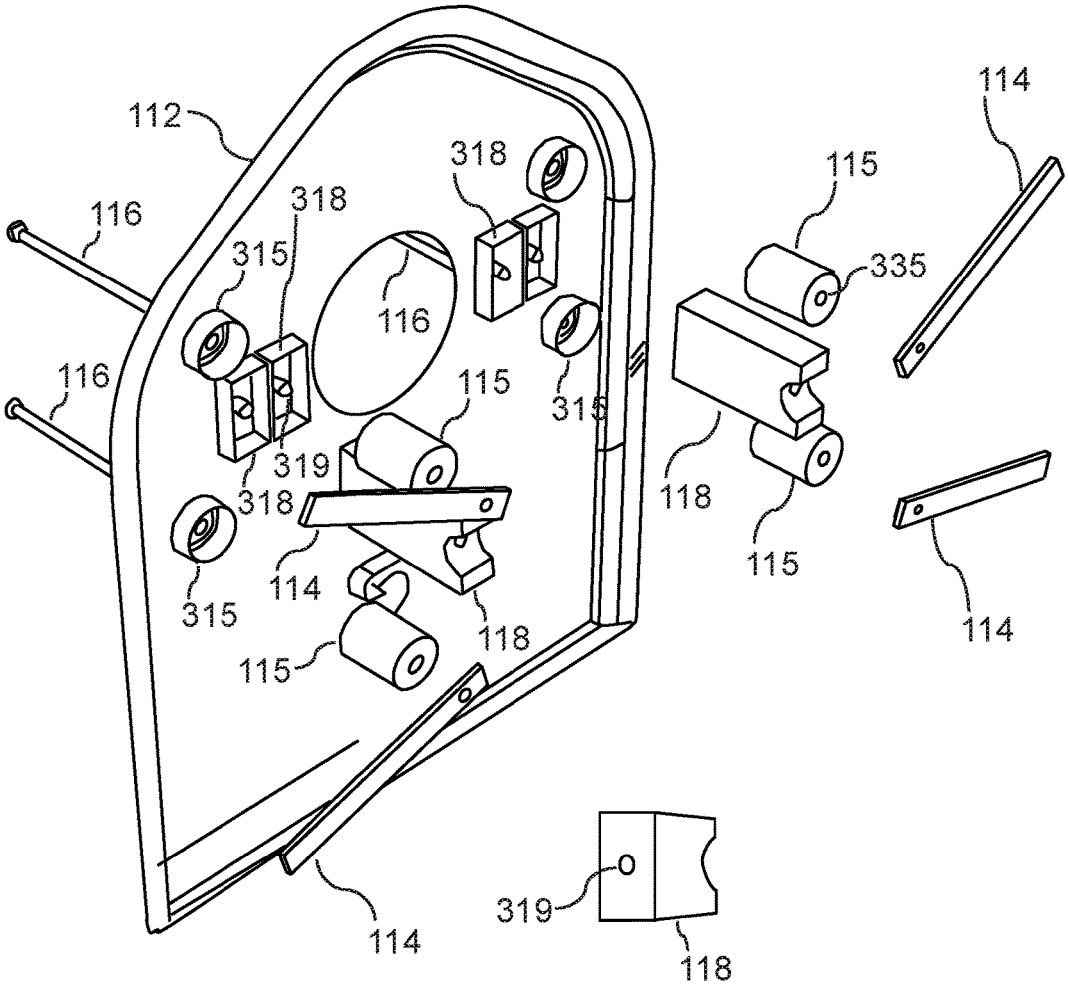
FIG. 3 is a perspective view of a valve repair kit, according to an embodiment of the invention.

In a related embodiment, as shown in FIG. 3, the main plate 112 can further include at least one standoff holder 315 connected to an inner side of the main plate 112, which at least one standoff holder 315 is configured to receive an outer end of a plate standoff 115. The main plate 112 can further include a standoff guide protrusion 316, located inside the at least one standoff holder 315, which standoff guide protrusion 316 inserts into a central aperture 335 of the outer end of the plate standoff 115, to stabilize the plate standoff 115.

In a related embodiment, as shown in FIG. 3, the main plate 112 can further include at least one spacer holder 318 connected to an inner side of the main plate 112, which at least one spacer holder 318 is configured to receive an outer end of a valve to plate spacer 118. The spacer holder 318 can include a spacer guide protrusion 319, located inside the spacer holder 318, which inserts into a receiving aperture 319 of the outer end of the valve to plate spacer 118, to stabilize the valve to plate spacer 118.

In a related embodiment, as shown in FIGS. 1, 4, 6A, and 6B, an inner side of the main plate 112 can further include a pipe connector 119 that is positioned adjacent to a pipe aperture 117 of the main plate 112, which pipe connector 119 is configured to receive a connection end 612 of a pipe holder 410, such that a holder end 614 is configured to attach to a tub pipe 140, to stabilize the tub pipe 140.

In a related embodiment, as shown in FIGS. 1, 4, 6A, and 6B, the valve repair system 100 can include:

a) a pipe connector 119, positioned adjacent to a pipe aperture 117 of the main plate 112; and
b) a pipe holder 410, comprising a connection part 412 and a holder part 414 connected to the connection part 412;

wherein the pipe connector 119 is configured to receive the connection part 412, such that the holder part 414 is configured to attach to a tub pipe 140, when the tub pipe 140 protrudes through the pipe aperture 117, to stabilize the tub pipe.

Figure 4:
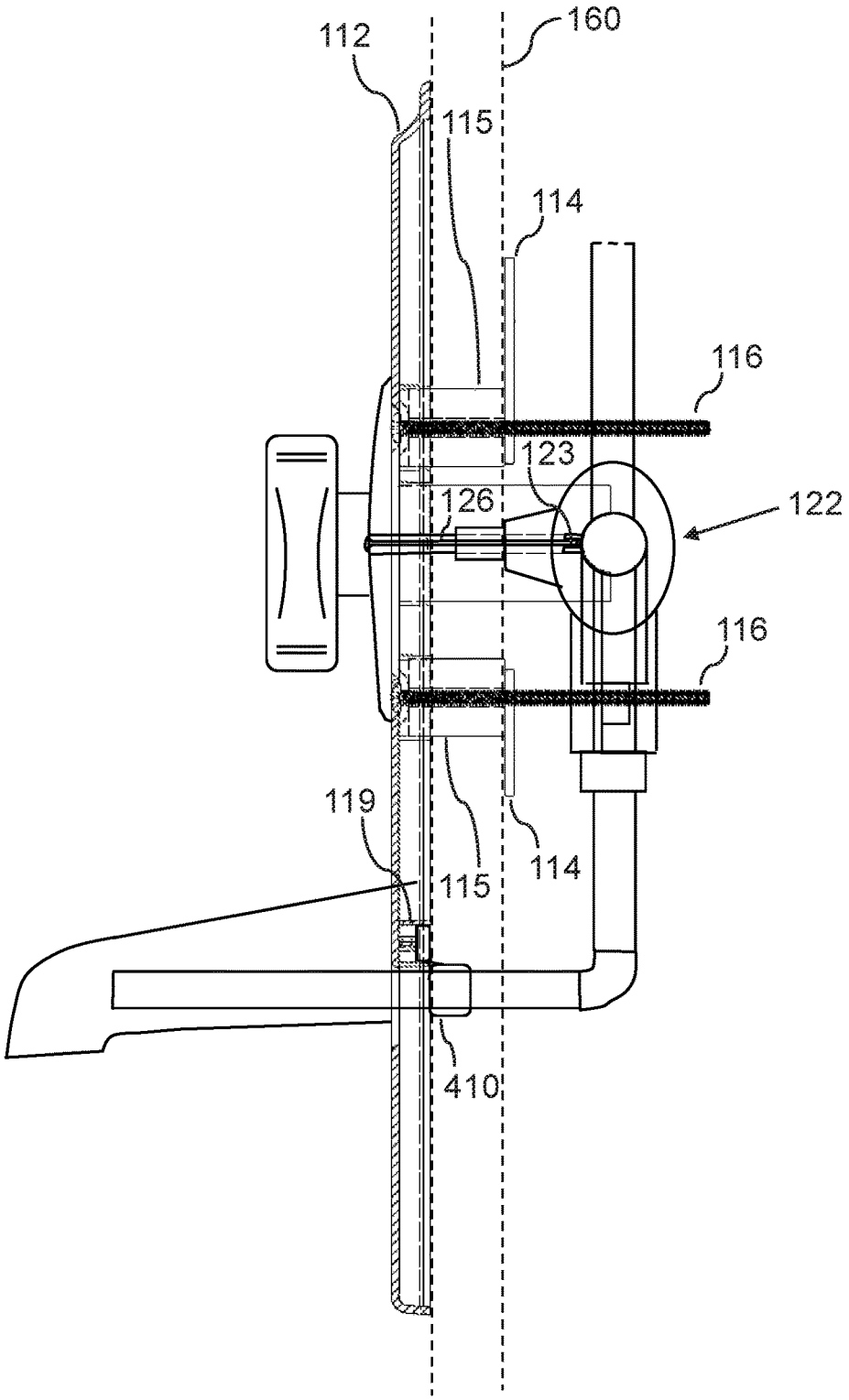
FIG. 4 is a cross-sectional side view of a valve repair system installed in a bathroom, according to an embodiment of the invention.

In a related embodiment, FIG. 4 shows a cross-sectional side view of the valve repair system 100 installed in a bathroom.

In a related embodiment, the valve repair system 100 can be configured to provide an effective and inexpensive way to replace a conventional 3-handle scald allowing tub and shower valve, without having to redo a whole new tub surround or bathroom, and provides for a much easier installation than using conventional oval style plates in this situation.

In an embodiment, a method of replacing a valve can include:

a) Breaking a hole in the in the wall around an existing/old, irreparable, 3-handle tub and shower valve;
b) Removing the existing valve and tub spout from that area;
c) Installing a new, modern, single handle anti scald valve and tub spout, while connecting to the existing pipes that feeds the shower head. This valve may be secured to the structure of the wall or may be left "floating" and only supported by the piping;
d) Securing the plate to the wall with the fasteners, standoffs and screws. The new valve would have to be piped properly so that the valve and tub spout pipe line up accordingly with the holes in the plate;
e) A seal can be made around the plate using customer supplied vinyl caulking. The valve to plate spacers can be provided in case the installer has decided to leave the valve floating in the wall. While utilizing the valve to plate spacers one can secure the floating valve to the secured plate. This is done by putting the spacers in between the back of the plate and face of the pipes that feed the valve on the left and right; and
f) The cover plate provided by the valve manufacturer is then screwed into the valve while pulling the valve towards the plate and "sandwiching" the valve to plate spacers therefore snugging up the floating valve permanently.

Here has thus been described a multitude of embodiments of the valve repair system 100, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent, and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. A valve repair system, comprising:

a main plate;

a plurality of fastener members, which are configured to secure the main plate around an opening in a wall;

a replacement valve, which is configured to connect to existing wall piping;

a front cover plate;

a plurality of cover plate fasteners; and at least two valve to plate spacers;

such that the at least two valve to plate spacers are configured to be positioned between the replacement valve and the main plate;

such that the at least two valve to plate spacers are locked tightly between the main plate and the replacement valve, when the replacement valve is pulled in towards the main plate; and wherein the front cover plate is mounted in front of the main plate, such that the front cover plate is tightened in place with the cover plate fasteners, such that the cover plate fasteners are fastened to the replacement valve, such that the front cover plate is tightened against the main plate with the cover plate fasteners, such that the replacement valve is pulled in towards the main plate.

2. The valve repair system of claim 1, wherein the valve repair assembly further comprises:

at least one plate standoff with a central aperture, such that the at least one plate standoff is mounted between the main plate and a fastener member in the plurality of fastener members.

3. The valve repair system of claim 2, wherein the valve repair assembly further comprises:

at least one main plate screw;

such that the at least one main plate screw protrudes through the central aperture of the at least one plate standoff, such that the at least one main plate screw is screwed into the fastener member.

4. The valve repair system of claim 1, wherein the cover plate fasteners are cover plate screws, such that the cover plate screws are screwed through cover plate apertures of the front cover and protrude through a main valve aperture of the main plate, such that the cover plate screws are screwed into screw apertures of the replacement valve.

5. The valve repair system of claim 2, further comprising at least one standoff holder connected to an inner side of the main plate, such that the at least one standoff holder is configured to receive an outer end of a plate standoff.

6. The valve repair system of claim 5, further comprising a standoff guide protrusion, positioned inside the at least one standoff holder, such that the standoff guide protrusion inserts into a central aperture of the outer end of the plate standoff, to stabilize the plate standoff.

7. The valve repair system of claim 1, further comprising at least one spacer holder connected to an inner side of the main plate, such that the at least one spacer holder is configured to receive an outer end of a valve to plate spacer of the at least two valve to plate spacers.

8. The valve repair system of claim 7, further comprising a spacer guide protrusion, positioned inside the at least one standoff holder, such that the spacer guide protrusion is configured to insert into a receiving aperture of an outer end of the valve to plate spacer, to stabilize the valve to plate spacer.

9. The valve repair system of claim 1, further comprising:

a) a pipe connector, positioned adjacent to a pipe aperture of the main plate; and b) a pipe holder, comprising a connection part and a holder part connected to the connection part;

wherein the pipe connector is configured to receive the connection part, such that the holder part is configured to attach to a tub pipe when the tub pipe protrudes through the pipe aperture, to stabilize the tub pipe.

10. A valve repair system, comprising:

a main plate;

a plurality of fastener members, which are configured to secure the main plate around an opening in a wall; and a front cover plate; and a plurality of cover plate fasteners; and at least one plate standoff with a central aperture, such that the at least one plate standoff is mounted between the main plate and a fastener member in the plurality of fastener members;

wherein the front cover plate is mounted in front of the main plate, and is tightened in place with the cover plate fasteners, such that the cover plate fasteners are configured to be fastened to a replacement valve in the opening in the wall, such that the front cover plate is tightened against the main plate with the cover plate fasteners, such that the replacement valve is pulled in towards the main plate.

11. The valve repair system of claim 10, wherein the valve repair assembly further comprises:

at least two valve to plate spacers;

such that the at least two valve to plate spacers are configured to be positioned between the replacement valve and the main plate;

such that the at least two valve to plate spacers are configured to be locked tightly between the main plate and the replacement valve.

12. The valve repair system of claim 10, wherein the valve repair assembly further comprises:

at least one main plate screw;

such that the at least on main plate screw protrudes through the central aperture of the at least one plate standoff, such that the at least one main plate screw is screwed into the fastener member.

13. The valve repair system of claim 10, wherein the cover plate fasteners are cover plate screws, such that the cover plate screws are screwed through cover plate apertures of the front cover and protrude through a main valve aperture of the main plate, such that the cover plate screws are screwed into screw apertures of the replacement valve.

14. The valve repair system of claim 10, further comprising at least one standoff holder connected to an inner side of the main plate, such that the at least one standoff holder is configured to receive an outer end of a plate standoff.

15. The valve repair system of claim 14, further comprising a standoff guide protrusion, positioned inside the at least one standoff holder, such that the standoff guide protrusion inserts into a central aperture of the outer end of the plate standoff, to stabilize the plate standoff.

16. The valve repair system of claim 11, further comprising at least one spacer holder connected to an inner side of the main plate, such that the at least one spacer holder is configured to receive an outer end of a valve to plate spacer of the at least two valve to plate spacers.

17. The valve repair system of claim 16, further comprising a spacer guide protrusion, positioned inside the at least one standoff holder, such that the spacer guide protrusion is configured to insert into a receiving aperture of an outer end of the valve to plate spacer, to stabilize the valve to plate spacer.

18. The valve repair system of claim 10, further comprising:

a) a pipe connector, positioned adjacent to a pipe aperture of the main plate; and b) a pipe holder, comprising a connection part and a holder part connected to the connection part;

wherein the pipe connector is configured to receive the connection part, such that the holder part is configured to attach to a tub pipe when the tub pipe protrudes through the pipe aperture, to stabilize the tub pipe.

19. A valve repair system, comprising:

a main plate;

a plurality of fastener members, which are configured to secure the main plate around an opening in a wall; and a front cover plate;

a plurality of cover plate fasteners;

a pipe connector, positioned adjacent to a pipe aperture of the main plate; and a pipe holder, comprising a connection part and a holder part connected to the connection part;

wherein the pipe connector is configured to receive the connection part, such that the holder part is configured to attach to a tub pipe when the tub pipe protrudes through the pipe aperture, to stabilize the tub pipe; and wherein the front cover plate is mounted in front of the main plate, and is tightened in place with the cover plate fasteners, such that the cover plate fasteners are configured to be fastened to a replacement valve in the opening in the wall, such that the front cover plate is tightened against the main plate with the cover plate fasteners, such that the replacement valve is pulled in towards the main plate.

* * * * *